US009133071B2

(12) United States Patent
Hahma

(10) Patent No.: US 9,133,071 B2
(45) **Date of Patent: *Sep. 15, 2015**

(54) ACTIVE COMPOSITION FOR A DECOY WHICH RADIATES SPECTRALLY ON COMBUSTION OF THE ACTIVE COMPOSITION

(71) Applicant: DIEHL BGT DEFENCE GMBH & CO. KG, Ueberlingen (DE)

(72) Inventor: Arno Hahma, Henfenfeld (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 102 days.

This patent is subject to a terminal disclaimer.

(21) Appl. No.: 13/969,752

(22) Filed: Aug. 19, 2013

(65) Prior Publication Data

US 2014/0060711 A1 Mar. 6, 2014

(30) Foreign Application Priority Data

Aug. 17, 2012 (DE) ..... 10 2012 016 454

(51) Int. Cl.

| | |
|---|---|
| ***C06B 29/22*** | (2006.01) |
| ***D03D 23/00*** | (2006.01) |
| ***D03D 43/00*** | (2006.01) |
| ***C06B 45/10*** | (2006.01) |
| ***C06C 15/00*** | (2006.01) |

(52) U.S. Cl.

CPC ..... *C06B 29/22* (2013.01); *C06B 45/105* (2013.01); *C06C 15/00* (2013.01)

(58) Field of Classification Search

USPC ..... 149/76, 109.2, 109.4

See application file for complete search history.

(56) References Cited

U.S. PATENT DOCUMENTS

| | | | | |
|---|---|---|---|---|
| 3,946,555 | A * | 3/1976 | Goede | 60/207 |
| 5,192,379 | A * | 3/1993 | Johnson et al. | 149/19.4 |
| 2002/0148540 | A1 * | 10/2002 | Hiskey et al. | 149/19.8 |
| 2009/0120545 | A1 * | 5/2009 | Webb et al. | 149/76 |

FOREIGN PATENT DOCUMENTS

| | | | |
|---|---|---|---|
| WO | 2007004871 | A2 | 1/2007 |
| WO | 2007004871 | A3 | 1/2007 |

* cited by examiner

*Primary Examiner* — James McDonough

(74) *Attorney, Agent, or Firm* — Laurence A. Greenberg; Werner H. Stemer; Ralph E. Locher

(57) ABSTRACT

An active composition for a decoy which radiates spectrally as the active composition burns up, including radiation emitted during combustion of the active composition in the wavelength range from 3.7 to 5.1 μm which is stronger by a factor of at least 15 than radiation emitted during combustion of the active composition in the wavelength range from 1.9 to 2.3 μm. The active composition contains a nitrate ester and/or one nitrosamine as a fuel having carbon atoms, hydrogen atoms, and ammonium perchlorate as oxidizer. The amount of the ammonium perchlorate is such that it is not sufficient for complete oxidation of the fuel. The active composition contains either the nitrate ester in the form of a polymeric solid, or a binder, not more than 5 carbon atoms in the fuel being joined to one another by direct bonding, and the active composition containing substantially no carbon source containing elemental carbon.

20 Claims, 2 Drawing Sheets

ACTIVE COMPOSITION FOR A DECOY WHICH RADIATES SPECTRALLY ON COMBUSTION OF THE ACTIVE COMPOSITION

CROSS-REFERENCE TO RELATED APPLICATION

This application claims the priority, under 35 U.S.C. §119, of German application DE 10 2012 016 454.8, filed Aug. 17, 2012; the prior application is herewith incorporated by reference in its entirety.

BACKGROUND OF THE INVENTION

Field of the Invention

The invention relates to an active composition (i.e. payload) for a decoy which radiates spectrally on combustion of the active composition, featuring a radiation emitted on combustion in the wavelength range from 3.7 to 5.1 μm (B band) which is stronger by a factor of at least 15 than a radiation emitted on combustion in the wavelength range from 1.9 to 2.3 μm (A band). By strength of the radiation is meant its intensity, i.e. its power per unit solid angle, measured in J/sr.

An active decoy composition with nitrocellulose and potassium perchlorate is known from Koch, E. C., Propellants Explos. Pyrotech. 2009, 34, pages 6 to 12. It has emerged, however, that the radiation emitted in the B band on combustion of this active composition is stronger by a factor of only about 5 than the A band radiation emitted during combustion.

International patent disclosure WO 2007/004871, corresponding to U.S. patent publication No. 2009/0120545, discloses a pyrotechnic composition for an infrared decoy that contains an extrudable and energetic nitrocellulose-containing binder, an oxidizer, a pyrotechnic fuel and a carbon source. The oxidizer may be $KClO_4$, $KClO_3$ or $NH_4ClO_4$, and the carbon source may be lamp black, carbon black, graphite, charcoal, coal or a material with the same function. With the active composition on combustion it is not possible to achieve any radiation emitted on combustion in the wavelength range from 3.7 to 5.1 μm that is stronger by a factor of at least 15 than radiation emitted on combustion in the wavelength range from 1.9 to 2.3 μm. For a pyrotechnic decoy to be able effectively, to a two-color seeker head, to mimic an aircraft from frontal viewing angles, however, it is useful for the spectral ratio on combustion of the active decoy composition to be extremely high, i.e. the ratio of the radiant intensity in the B band to the radiant intensity in the A band. In order to be able to use customary decoy calibers to mimic large aircraft, furthermore, the active composition must be very powerful on combustion, especially at high air speed.

BRIEF SUMMARY OF THE INVENTION

It is an object of the present invention to provide an active decoy composition which on combustion emits radiation in the wavelength range from 3.7 to 5.1 μm which is stronger by a factor of at least 15 than radiation emitted on combustion in the wavelength range from 1.9 to 2.3 μm and which at the same time is very powerful.

Provided in accordance with the invention is an active composition for a decoy which radiates spectrally on combustion of the active composition, featuring radiation emitted on combustion of the active composition in the wavelength range from 3.7 to 5.1 μm that is stronger by a factor of at least 15 than radiation emitted on combustion of the active composition in the wavelength range from 1.9 to 2.3 μm. The active composition contains at least one nitrate ester and/or one nitrosamine as fuel containing carbon atoms and hydrogen atoms, and ammonium perchlorate as oxidizer, the amount of the ammonium perchlorate being such that it is not sufficient for complete oxidation of the fuel, and the active composition containing either the nitrate ester in the form of a polymeric solid, or a binder. In the fuel not more than 5 carbon atoms are joined to one another by direct bonding. At least every sixth atom, therefore, is a heteroatom, such as oxygen, nitrogen or sulphur, for example. In this way the formation of soot, which on glowing is a highly efficient blackbody radiator, is at least largely prevented. A soon as 6 carbon atoms are joined to one another by direct bonding, pyrolysis may be accompanied by ring closure and hence by the formation of an aromatic structure. This then leads to the formation of soot as a polyaromatic substance which shifts the spectrum of the emitted radiation in the direction of the A band. With not more than 5 C atoms joined to one another by direct bonding, the formation of aromatic structures is highly unlikely, and the formation of soot is largely eliminated.

Furthermore, the active composition contains substantially no carbon source containing elemental carbon. In one refinement the active composition also contains at least substantially no substance that on combustion generates elemental carbon, in the form of soot, for example. "Substantially" here means that none of the selected constituents of the active composition of the invention contains such a carbon source or substance, or the active composition contains at least not more than 0.2% by weight of such a carbon source or substance. The unintended presence of traces of such a carbon source or substance can of course not be completely ruled out. On combustion, the active composition of the invention ought not to generate more than 1% by weight of the active composition of solid particles in the flame. On glowing, such particles and elemental carbon or soot generate blackbody radiation in the flame and so generate radiation in the A band. The ammonium perchlorate present as oxidizer in the active composition as well leaves exclusively gaseous residues on combustion and hence does not contribute to the formation of blackbody radiation.

In the active composition, the polymeric solid also takes on the function of a binder. There is therefore no need for further binder. The solid in this case may also be a viscoelastic material. The viscoelasticity may be brought about or modulated by further components of the active composition, such as an ionic liquid, for example.

The particular feature of the invention is that the nitrate ester and/or the nitrosamine serve not only as fuel and, in the case of the nitrate ester, possibly as binder, but also to expand the primary flame produced on combustion. A primary flame is a flame which is formed by reaction of gas from the fuel with gas from the oxidizer. The expansion of the primary flame is accomplished by exothermic decomposition of the nitrate ester and nitrosamine in the course of combustion at a temperature of just between 150° C. and 250° C., with the accompanying generation of combustible gases. As a result, the temperature of the primary flame is relatively low. Since the amount of the oxidizer in the active composition is not sufficient for complete oxidation, combustible gases remain that are able to react with atmospheric oxygen. Since, however, the primary flame has a relatively low temperature, the reaction with atmospheric oxygen begins relatively slowly, and hence the flame occupies a greater volume. The gases formed undergo combustion at the outer flame edge with the atmospheric oxygen that is available there. Consequently, a major fraction of the radiation is emitted and not absorbed in the flame. The hottest area of the flame in this case is generated in the region of combustion with the atmospheric oxygen. As a result, water and any solid particles remain relatively cold until this zone is reached, with only slight radiation occurring in the A band. Carbon dioxide which is or has formed, in contrast, becomes very hot in the outermost zone of the flame, and emits copious amounts of radiation in the B band. Any soot particles produced burn up rapidly in the air or cool down rapidly, and so emit virtually no A band radiation. As a result of the support of the combustion process by air, the temperature in the flame is retained for a relatively long time, and the flame surface essential for emission of radiation becomes relatively large. At the same time, the solid-state reaction at the burning surface is maintained at relatively low temperature by the flame. The overall outcome is a flame with relatively low temperature, high power, and a radiation spectrum shifted towards the B band.

As a result of the deficiency of oxidizer, the active composition has an oxygen deficit. On combustion, therefore, the atmospheric oxygen serves as a further oxidizer. In comparison to an active composition with equal balance of oxygen, it is possible to include more fuel in relation to the oxidizer within a given quantity of the active composition.

Another important aspect of the ammonium perchlorate oxidizer used here is that ammonium perchlorate on combustion generates a heterogeneous flame structure and hence ensures that the flame is not extinguished even at high wind speed, of the kind present in use in the case of a flying decoy.

Furthermore, the active composition burns up, as a result of the heterogeneous flame structure generated by the ammonium perchlorate, even at a low air pressure, of the kind which prevails in the case of the decoy flying at a great height. Prevention of the flame being extinguished, either under reduced pressure or in strong wind, does not necessitate further measures, as is sometimes the case with known nitrocellulose-containing active decoy compositions.

A further key advantage of the active composition of the invention is that it can be manufactured very inexpensively. It has emerged, furthermore, that the volume of the active composition decreases when it is heated. This increases the safety of the active composition in the event of a fire and of any accompanying rapid strong heating or in the case of slow heating, such as during storage in the sun, for example. The decrease in volume of the active composition produces an empty space in the decoy and, in the event of any unintended ignition, the pressure within the decoy does not rise so suddenly as with active compositions where there is no volume decrease on heating. The reaction in these situations is therefore less vigorous than with known active compositions. It has emerged, furthermore, that after being pressed, the active composition of the invention does not expand by 0.2% to 2%, in contrast to known active decoy compositions. A pressing tool can therefore be produced that provides exactly the desired nominal dimensions. The production of an active composition with desired nominal dimensions is thereby made much easier.

In one refinement of the active composition of the invention, the binder contains starch, a polybutadiene, a polymer which generates only gaseous decomposition products on combustion of the active composition, such as polyvinylpyrrolidone (PVP), polyvinyl butyral, polyvinyl alcohol or polyvinyl acetate, for example, or a polymer having nitrate ester groups, more particularly nitrocellulose, polyvinyl nitrate, polyglycidyl nitrate or GAP (glycidyl azide polymer).

The nitrate ester may be liquid. It may contain glyceryl trinitrate, ethylene glycol dinitrate, diethylene glycol dinitrate, triethylene glycol dinitrate or methriol trinitrate. In this case the liquid nitrate ester may also serve as plasticizer for the binder and may thereby phlegmatize the active composition, so making it less sensitive to impact and friction. Moreover, as a result of this plasticization, the active composition becomes self-lubricating, and hence the friction is reduced, the pressing of the active composition is facilitated, and the sensitivity of the active composition is reduced. The nitrate ester may also contain nitrocellulose, polyvinyl nitrate or polyglycidyl nitrate as polymeric solid. The nitrosamine may contain 1,3,5-trinitroso-1,3,5-hexahydrotriazine. All of the stated nitrate esters and the stated nitrosamine have proved to be very efficient primary flame expanders. The active composition of the invention is much easier to mix and to work than are active compositions containing curing resins or curing polymers. They can be mixed easily and pressed immediately thereafter. No solvent is needed. Nevertheless, the active compositions have proved to be more mechanically stable than conventional spectral active compositions. The mechanical stability can be boosted by subsequent sintering of the active composition of the invention.

The liquid nitrate esters are able to function particularly well as plasticizers for nitrocellulose. They swell the nitrocellulose and convert it into an elastomer. As a result, the active composition can be mixed and pressed without further solvent.

The binders as well may on combustion be gasified initially endothermically, with formation of exclusively gaseous decomposition products. The decomposition products may then generate a secondary flame, which burns outside of the broadened primary flame with the atmospheric oxygen, and may thereby expand the flame further.

The active composition of the invention, furthermore, may contain at least one further fuel which undergoes endothermic decomposition at a higher temperature than the decomposition temperature of the nitrate ester and/or of the nitrosamine, with formation of at least one combustible gas. "Endothermic decomposition" means that with increasing temperature there is at least initially a temperature range within which the decomposition takes place endothermically. As a result, the temperature of the flame is effectively limited in the region of the endothermic decomposition. By "decomposition" here is also meant boiling or gasification. The surface of the active composition burning up ought to be cooled as little as possible, or not at all, by the further fuel, however. The boiling point or the decomposition temperature of the further fuel ought therefore to be extremely high. Furthermore, as far as possible, the further fuel ought to have a negative oxygen balance, but ought not to form any soot on combustion. In the case of combustion, in contrast, the further fuel ought to generate an extremely high heat of combustion—that is, the further fuel ought to have a very high energy content.

The further fuel ought not to be able to react with the nitrate ester and/or with the nitrosamine. As a result of the associated compatibility, a long storage life is achieved. The further fuel serves as a flame expander in the sense that the higher decomposition temperature means that on combustion a further flame zone is formed since within the primary flame there is no ignition of the gasified further fuel.

The further fuel may be an amine, amide, nitrile, cyanate, isocyanate, urethane, imine, ketimine, imide, azide, nitramine, nitrosamine, hydroxylamine, hydrazine, hydrazone, oxime, furoxan, furazan, tertiary ammonium salt, urea, methylurea, dimethylurea, trimethylurea, tetramethylurea, guanidine salt, mono-aminoguanidine salt, diaminoguanidine salt, triaminoguanidine salt or azo compound, a nitrate ester, nitrite ester or nitrogen heterocycle, a nitro compound, nitroso compound or quaternary ammonium compound.

Each of the aforementioned compounds here contains at least one C—N, C—N—O or C—O—N moiety and optionally a C—O moiety. The stated groups here may be present in linear or cyclic chains and with single, double or triple bonds. By these structural features, nitrogen excited in the flame is able to transmit its energy with a high yield to carbon monoxide or carbon dioxide and hence excite the oxide. The carbon monoxide or carbon dioxide then emits the energy it has acquired in this way in the form of infrared radiation in the B band. Through binding of nitrogen to carbon, the transmission of energy is particularly effective and the radiation yield is increased. It is not weakened by an oxygen bridge between nitrogen and carbon atoms, because the energy can also be transmitted via the oxygen atom to the carbon oxide.

In the case of one refinement, the active composition contains dicyandiamide, azodicarbonamide, dinitrosopentamethylenetetramine (DNPT), glyoxime, oxamide, acetamide, carbazide, semicarbazide, diethylene glycol dinitrate, triethylene glycol dinitrate or methriol trinitrate as a further fuel.

In a further refinement, the active composition contains a plurality of further fuels having different decomposition temperatures. As a result it is possible to generate a plurality of temperature zones in the flame and so to realize a very high radiant intensity. For generation of an outer flame zone, the further fuel or the plurality of further fuels may contain a further fuel in dust form, more particularly a cyanogen compound, more particularly paracyanogen, or a further fuel which forms a mist by atomization on combustion of the active composition, more particularly an ionic liquid, more particularly an ionic liquid containing an imidazole, pyridine, diazine or other heterocyclic structure, more particularly 1-butyl-3-methylimidazolium perchlorate (BMIM-$ClO_4$). An advantage associated with the ionic liquid is that it renders the active composition electrically conductive and hence insensitive with respect to electrostatic discharge. Moreover, ionic liquids have a phlegmatizing effect in the active composition, thereby reducing the sensitivity of the active composition with respect to friction, impact and collision.

The active composition of the invention may further contain a stabilizer from the group of akardites or centralites, more particularly N,N-diphenylurea (akardite I), N-methyl-N,N-diphenylurea (akardite II), 1,3-diethyl-1',3'-diphenylurea (centralite I), 1,3-dimethyl-1',3'-diphenylurea (centralite II) or N-methyl-N'-ethyl-N,N'-diphenylurea (centralite III).

Present within the active composition may be a catalyst containing copper atoms or iron atoms, more particularly iron oxide, ferrocene, iron acetonylacetate or copper phthalocyanine. The catalyst facilitates the reaction of ammonium perchlorate at relatively low temperature and so stabilizes combustion.

In one refinement there are present in the active composition (apart from the catalysts) substantially no substances containing atoms other than carbon, hydrogen, nitrogen, oxygen, sulphur, chlorine and bromine. This prevents the formation of combustion products that shift the spectrum in the direction of the A band. "Substantially" here means that none of the selected constituents of the active composition of the invention contains these substances. The presence of traces of substances containing such atoms, however, can of course not be ruled out entirely.

Other features which are considered as characteristic for the invention are set forth in the appended claims.

Although the invention is illustrated and described herein as embodied in an active composition for a decoy which radiates spectrally on combustion of the active composition, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
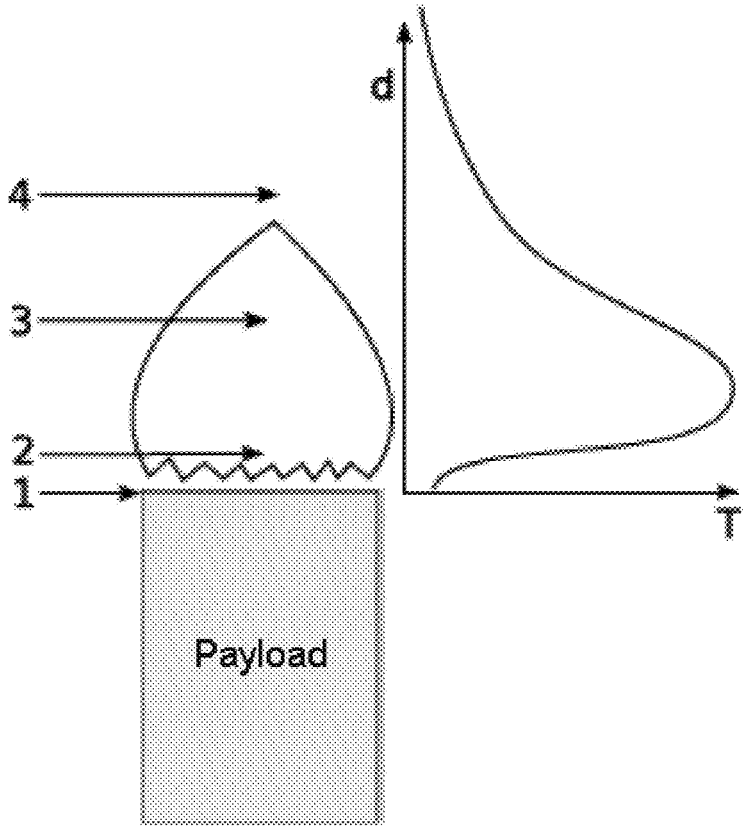
FIG. 1 PRIOR ART
FIG. 1 is a schematic representation of an operating principle of a conventional active composition.

Referring now to the figures of the drawings in detail and first, particularly to FIG. 1 thereof, there is shown on the left a schematic representation of the combustion of a conventional active composition (payload) and to the right of that a profile of a temperature T of a flame produced during combustion, in relation to a distance d from a burning surface 1 of a payload. The temperature of the burning surface 1 of the payload is situated at the decomposition temperature of the component of the active composition that decomposes at the lowest temperature. Hot gases emerge from the surface and form a diffusion zone 2. In the diffusion zone 2, oxidizing gases from one oxidizer present in the payload, and combustible gases from a fuel present in the payload, become mixed and begin to react with one another in a flame. The temperature here rises rapidly up to a maximum in a reaction zone 3. The gases react rapidly at high temperature, which cools again rapidly to ambient temperature in a region 4 outside the flame. The flame is very hot in its interior but cools down rapidly at the edges. The radiation yield is low and all solid particles and also water vapor radiate in the very hot flame in the A band. The spectral ratio, i.e. the ratio of the intensity of the B band radiation to the intensity of the A band radiation, is consequently in general not more than 10.

Figure 2:
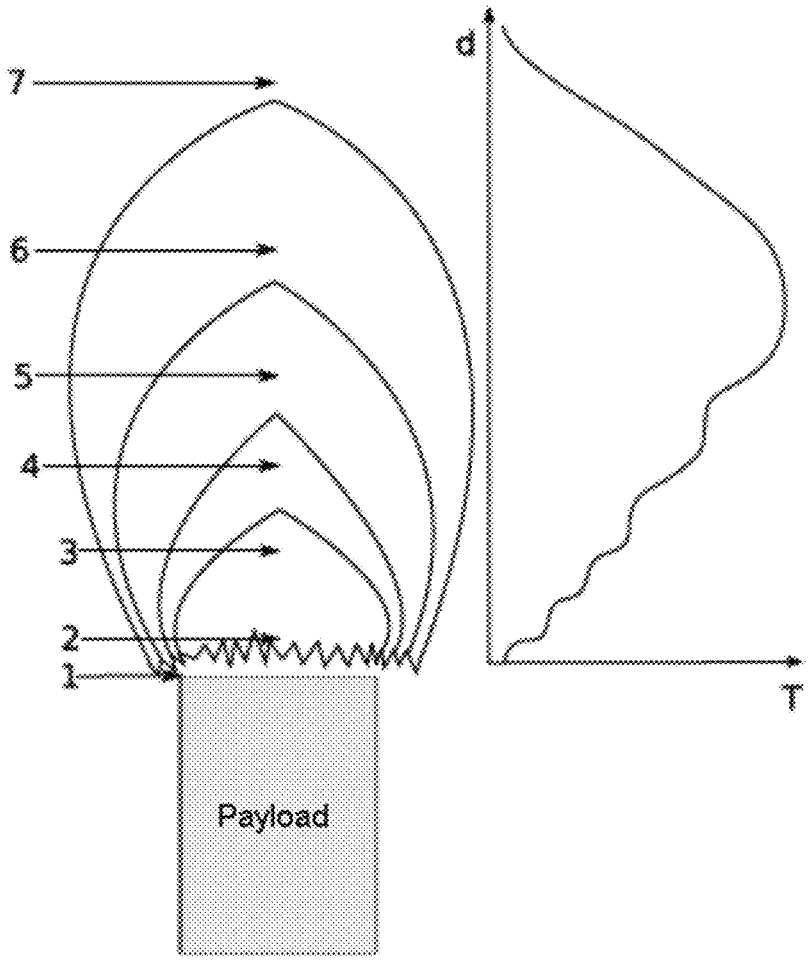
FIG. 2 is a schematic representation of the operating principle of an inventive active composition.

FIG. 2 shows on the left a schematic representation of the heterogeneous combustion of an inventive payload featuring a plurality of further fuels for flame expansion and on the right alongside it a profile of the temperature T of the flame produced during its combustion, in relation to the distance d from the burning surface 1 of the payload. In contrast to the combustion of the payload depicted in FIG. 1, the diffusion zone here, as a result of ammonium perchlorate as oxidizer, is heterogeneous, and also has a large oxygen deficit and is cold. The fuel, which acts simultaneously as a flame expander for the primary flame, is decomposed at a relatively low temperature, thereby limiting the temperature at the surface of the payload to this decomposition temperature. In the flame 3, the gases from the oxidizer and the fuel, mixed in the diffusion zone 2, undergo reaction. In zone 3, further fuels from the payload are as yet unable to react, since the temperature in the primary flame 3 is still too low for them to do so. The temperature of zone 4 is limited by the decomposition temperature of one of the further fuels. In zone 5, a secondary flame is formed by combustion of the further fuel decomposed in zone 4, and another of the further fuels undergoes decomposition, preferably to form a mist. In that case there is a further increase in temperature, but not one sufficient to cause the remainder of the further fuels to react. The temperature in zone 5 is limited through the decomposition temperature of the further fuels among the other fuels. This further fuel begins to absorb thermal energy efficiently only at the temperature in zone 5. In zone 6, the decomposed further fuel reacts with the atmospheric oxygen. The temperature in this case may rise up to the adiabatic maximum. As a result of air assistance to the combustion process, the temperature above the flame in the aerobic region 7 does not drop as rapidly as in the case of the payload according to FIG. 1. The flame becomes very large and is very hot only on the outer area of zone 6, where a large proportion of the radiation is able to flow to the outside without being absorbed in the flame. Prior to the aerobic region 7, water and solid particles remain relatively cold, and so only small amounts of radiation in the A band are produced, whereas carbon dioxide in the outer region of zone 6 radiates strongly in the B band. Particles which burn up in the air in the aerobic zone 7 are very short-lived in their hot and hence radiating state, and hence cause only insubstantial shifting of the spectrum of emitted radiation in the direction of the A band.

5 pellets each with 10 g of active composition were pressed in each of the active compositions below. The pellets were burned up, and their radiant intensity was recorded using a two-channel radiometer. Serving as a standard here is the active composition MTV, given as Example 1. The radiant intensity when the pellets are burned up is expressed as a percentage of the radiant intensity of MTV.

200 g of the ionic liquid BMIM-$ClO_4$, used in some of the active compositions specified below, were synthesized as follows:

150 g of BMIM-Cl were dissolved in about 600 ml of dry methanol at 25° C. in a 2-liter one-neck flask. A stoichiometric amount of dry sodium perchlorate was likewise dissolved separately in 600 ml of dry methanol in a 2-liter one-neck flask. The entire perchlorate solution was then added all at once to the BMIM chloride solution. The flask previously containing the perchlorate solution was further washed with 3×50 ml of dry methanol, and the methanol as well was added to the BMIM chloride solution. The resulting solution, after a few minutes, became cloudy and yellow, as the resulting sodium chloride began to precipitate.

The overall solution was then boiled under reflux for an hour. Thereafter the hot solution was filtered through a frit into a 2-liter one-neck flask, and the residue was washed with 3×50 ml of dry methanol. The filtercake, consisting almost exclusively of sodium chloride, was removed.

The one-neck flask was then connected to a rotary evaporator and the methanol was distilled off under a pressure of around 500 mbar, the water bath having been heated to 90° C. in an evaporator. When the methanol had distilled off, the hot crude BMIM-$ClO_4$ was filtered from the flask again through the frit into a 250 ml separating funnel, since further sodium chloride had precipitated during the evaporation of methanol.

The finished BMIM-$ClO_4$ (a yellowish, viscous oil) was filled from the separating funnel into a laboratory flask, and weighed. The yield was almost quantitative.

Example 1

Standard MTV (Magnesium-Teflon-Viton)

| Substance | Type | % by weight | Other |
|---|---|---|---|
| Magnesium powder | Ecka LNR 61 | 60.0 | |
| Teflon powder | Hoechst TF 9202 | 25.0 | |
| Viton | 3M Fluorel FC-2175 | 10.0 | TMD = 1893 |
| Graphite | Merck | 5.0 | Lubricant |

TMD = Theoretical maximum density (in kg/$m^3$)

Example 2

Known spectrally adapted active composition based on ammonium perchlorate. This active composition has a relatively high spectral ratio but relatively low energy. The spectral ratio means the ratio of the radiant intensity in the B band to the radiant intensity in the A band.

| Substance | Type | % by weight | Other |
|---|---|---|---|
| Ammonium perchlorate | | 85.50 | |
| HTPB | R45HT-M M = 2800 | 13.47 | |
| IPDI | | 1.01 | TMD = 1678 |
| Iron acetonylacetate | | 0.02 | |

HTPB = Hydroxyl-terminated polybutadiene
IPDI = Isophorone diisocyanate

Example 3

Spectrally adapted active composition based on ammonium perchlorate. This active composition has a relatively high spectral ratio but relatively low energy. This active composition shows the effect of the further fuel hexamethylenetetramine: with the same oxygen balance as the active composition of Example 2, a higher radiation energy is achieved, but the spectral ratio remains unchanged.

| Substance | Type | % by weight | Other |
|---|---|---|---|
| Ammonium perchlorate | $D_50$ = 25 μm | 77.8 | |
| HTPB | R45HT-M M = 2800 | 10.32 | |
| IPDI | | 0.78 | TMD = 1678 |
| Hexamethylenetetramine | crystalline | 11.0 | |
| Iron acetonylacetate | | 0.10 | |

Example 4

Known propellant charge powder with higher energy and higher spectral ratio than the active composition of Examples 2 and 3. Without costly and inconvenient apparatus, the active composition does not burn at high wind speed, because the flame is homogeneous.

| Substance | Type | % by weight | Other |
|---|---|---|---|
| Nitrocellulose | 13.0% N | 100.0 | |

Example 5

The active composition with nitrocellulose as a binder and a flame expander and dioctyl adipate as a plasticizer. This active composition has the same oxygen balance as the active composition of Examples 2 and 3, but about twice the energy and twice the spectral ratio, and hence shows the effect of the nitrate ester nitrocellulose as a flame expander.

| Substance | Type | % by weight | Other |
|---|---|---|---|
| Ammonium perchlorate | ground $d_{50}$ = 25 μm | 41.0 | |
| Nitrocellulose | Hagedorn H24 | 50.25 | T = 2130K |
| Dioctyl adipate | BASF | 8.85 | TMD = 1575 |

Example 6

Inventive active composition with nitrocellulose as binder, diethylene glycol dinitrate (DEGDN) as fuel and plasticizer, and oxamide as further fuel and flame expander, and also akardite II as stabilizer and a flame expander. The active composition is substantially more powerful than the active composition according to Example 4. This active composition shows the overall effect of the nitrate ester nitrocellulose, the further fuel, and the more negative oxygen balance without formation of soot. The spectral ratio is improved as well, since this charge burns up at about 700 K less than the active composition of Example 4.

| Substance | Type | % by weight | Other |
|---|---|---|---|
| Ammonium perchlorate | ground $d_{50}$ = 25 μm | 18.10 | |
| Nitrocellulose | Hagedorn H24 | 31.70 | T = 1430K |
| DEGDN | synthesized in-house | 21.10 | TMD = 1641 |
| Oxamide | powder | 28.90 | |
| Akardite II | | 0.10 | |

Example 7

Inventive active composition with liquid salt (ionic liquid) as additional further fuel, flame expander and plasticizer, an additional flame zone being formed and the flame becoming even larger. This is evident from the specific power and from the spectral ratio. Both are higher than with the active composition of Example 5, despite the charge burning somewhat hotter.

| Substance | Type | % by weight | Other |
|---|---|---|---|
| Ammonium perchlorate | ground $d_{50}$ = 25 μm | 19.90 | |
| Nitrocellulose | Hagedorn H24 | 41.50 | T = 1500K |
| DEGDN | synthesized in-house | 11.80 | TMD = 1645 |
| BMIM-$ClO_4$ | synthesized in-house | 5.90 | |
| Oxamide | powder | 20.80 | |
| Akardite II | | 0.10 | |

BMIM-$ClO_4$ = 1-Butyl-3-methylimidazolium perchlorate, a liquid salt.

Example 8

Inventive active composition with nitrocellulose, diethylene glycol dinitrate as fuel and plasticizer, BMIM-$ClO_4$ as further fuel and flame expander and additional plasticizer, and also paracyanogen as other further fuel and flame expander in dust form. This active composition has an extremely high specific energy and also an extremely high spectral ratio.

| Substance | Type | % by weight | Other |
|---|---|---|---|
| Ammonium perchlorate | ground $d_{50}$ = 25 μm | 20.30 | |
| Nitrocellulose | Hagedorn H24 | 41.70 | T = 1830K |
| DEGDN | synthesized in-house | 11.80 | TMD = 1702 |
| BMIM-$ClO_4$ | synthesized in-house | 5.9 | |
| Paracyanogen | powder | 20.20 | |
| Akardite II | | 0.10 | |

Example 9

Inventive active composition with nitrocellulose, diethylene glycol dinitrate as fuel and plasticizer, dicyandiamide as further fuel and flame expander, and BMIM-$ClO_4$ as other further fuel, flame expander in mist form and additional plasticizer. This active composition likewise has an extremely high specific energy and also an extremely high spectral ratio.

| Substance | Type | % by weight | Other |
|---|---|---|---|
| Ammonium perchlorate | ground $d_{50}$ = 25 μm | 21.90 | |
| Nitrocellulose | Hagedorn H24 | 37.90 | T = 1470K |
| DEGDN | synthesized in-house | 10.80 | TMD = 1583 |
| BMIM-$ClO_4$ | synthesized in-house | 5.40 | |
| Dicyandiamide | crystalline | 24.00 | |
| Akardite II | | 0.10 | |

Example 10

Inventive active composition with nitrocellulose, diethylene glycol dinitrate as fuel and plasticizer, azodicarbonamide as further fuel and flame expander, and BMIM-$ClO_4$ as other further fuel, flame expander in mist form and additional plasticizer. This active composition likewise has a very high specific energy and also an extremely high spectral ratio.

TABLE 1

Results of radiation measurements in the laboratory without wind. All results are average values from 5 parallel experiments. The pressing pressure for all the charges was 1,000 bar, using a 17 mm tool diameter, batch 10.0 g.

| Substance | Type | % by weight | Other |
|---|---|---|---|
| Ammonium perchlorate | ground $d_{50}$ = 25 μm | 19.90 | |
| Nitrocellulose | Hagedorn H24 | 39.40 | T = 1790K |
| DEGDN | synthesized in-house | 11.00 | TMD = 1645 |
| BMIM-$ClO_4$ | synthesized in-house | 5.60 | |
| Azodicarbonamide | crystalline | 24.00 | |
| Akardite II | | 0.10 | |

| Charge | $E_a$[J/(g sr)] | $E_b$[J/(g sr)] | ($E_a$ + $E_b$) [J/(g sr)] | $E_b/E_a$ | % MTV (MW channel) |
|---|---|---|---|---|---|
| Example 1 | 152 | 84 | 236 | 0.553 | 100 |
| Example 2 | 2.7 | 19.8 | 22.5 | 8.7 | 24 |
| Example 3 | 3.7 | 31.3 | 35.0 | 8.7 | 37.2 |
| Example 4 | 4.1 | 78.8 | 82.9 | 19.2 | 94 |

-continued

| Charge | $E_a$[J/(g sr)] | $E_b$[J/(g sr)] | ($E_a + E_b$) [J/(g sr)] | $E_b/E_a$ | % MTV (MW channel) |
|---|---|---|---|---|---|
| Example 5 | 3.4 | 76.5 | 80.0 | 22.2 | 91 |
| Example 6 | 3.7 | 90.9 | 94.6 | 24.6 | 108 |
| Example 7 | 3.7 | 100.9 | 104.6 | 27.3 | 120 |
| Example 8 | 5.1 | 148.8 | 153.9 | 29.2 | 177 |
| Example 9 | 7.1 | 124.0 | 131.2 | 17.3 | 148 |
| Example 10 | 3.5 | 100.4 | 103.9 | 28.7 | 120 |

$E_a$ = Specific energy in the SW channel (about 1.9 to 2.3 μm) in J/(g sr);

$E_b$ = specific energy in the MW channel (about 3.7 to 5.1 μm) in J/(g sr); ($E_a + E_b$) in J/(g sr) = the sum total of SW and MW channels; $E_b/E_a$ = the ratio of MW to SW channel; % MTV = intensity as a percentage of the intensity of standard MTV; SW = short-wave; MW = medium-wave.

The invention claimed is:

1. An active composition for a decoy which radiates spectrally as the active composition burns up, including radiation emitted during combustion of the active composition in a wavelength range from 3.7 to 5.1 μm which is stronger by a factor of at least 15 than the radiation emitted during combustion of the active composition in the wavelength range from 1.9 to 2.3 μm, the active composition comprising:

a fuel, containing at least one compound selected from the group consisting of a nitrate ester and a nitrosamine, and having carbon atoms and hydrogen atoms;

ammonium perchlorate as an oxidizer, an amount of said ammonium perchlorate being such that it is not sufficient for complete oxidation of said fuel; and the active composition containing either said nitrate ester in a form of a polymeric solid, or a binder, not more than 5 of said carbon atoms in said fuel being joined to one another by direct bonding, and the active composition containing substantially no carbon source containing elemental carbon and, apart from an optional catalyst, substantially no substances containing atoms other than carbon, hydrogen, nitrogen, oxygen, sulphur, chlorine and bromine.

2. The active composition according to claim 1, wherein said binder is selected from the group consisting of starch, a polybutadiene, a polymer generating only gaseous decomposition products on combustion of the active composition, polyvinylpyrrolidone (PVP), poly-vinyl butyral, polyvinyl alcohol, polyvinyl acetate, and a polymer having nitrate ester groups.

3. The active composition according to claim 1, wherein:

the active composition contains the binder and said nitrate ester being liquid and containing a compound selected from the group consisting of glyceryl trinitrate, ethylene glycol dinitrate, diethylene glycol dinitrate, triethylene glycol dinitrate, and methriol trinitrate; and said nitrosamine containing 1,3,5-trinitroso-1,3,5-hexahydrotriazine or din itrosopentamethylenetetramine.

4. The active composition according to claim 1, further comprising at least one further fuel which decomposes endothermically at a higher temperature than a decomposition temperature of said nitrate ester or said nitrosamine, with production of at least one combustible gas.

5. The active composition according to claim 4, wherein:

said further fuel contains a compound selected from the group consisting of amine, amide, nitrile, cyanate, isocyanate, urethane, imine, ketimine, imide, azide, nitramine, nitrosamine, hydroxylamine, hydrazine, hydrazone, oxime, furoxan, furazan, tertiary ammonium salt, urea, methylurea, dimethylurea, trimethylurea, tetramethylurea, guanidine salt, monoaminoguanidine salt, diaminoguanidine salt, triaminoguanidine salt, azo compound, nitrate ester, nitrite ester, nitrogen heterocycle, nitro compound, nitroso compound and quaternary ammonium compound, said compound containing at least one C—N, one C—N—O or one C—O—N moiety.

6. The active composition according to claim 5, wherein said further fuel is selected from the group consisting of dicyandiamide, azodicarbonamide, dinitrosopentamethylenetetramine (DNPT), glyoxime, oxamide, acetamide, carbazide, semicarbazide, diethylene glycol dinitrate, triethylene glycol dinitrate and methriol trinitrate.

7. The active composition according to claim 4, wherein said further fuel is one of a plurality of further fuels having different decomposition temperatures.

8. The active composition according to claim 4, wherein said further fuel is in dust form.

9. The active composition according to claim 1, further comprising a stabilizer selected from the group consisting of akardites, centralites, N,N-diphenylurea (akardite I), N-methyl-N,N-diphenylurea (akardite II), 1,3-diethyl-1',3'-diphenylurea (centralite I), 1,3-dimethyl-1',3'-diphenylurea (centralite II) and N-methyl-N'-ethyl-N,N'-diphenylurea (centralite III).

10. The active composition according to claim 1, further comprising a catalyst containing one of copper atoms, iron atoms, iron oxide, ferrocene, iron acetonylacetate or copper phthalocyanine.

11. The active composition according to claim 2, wherein said polymer having nitrate ester groups are selected from the group consisting of nitrocellulose, polyvinyl nitrate, methylnitraminocellulose and polyglycidyl nitrate.

12. The active composition according to claim 1, wherein:

said nitrosamine contains 1,3,5-trinitroso-1,3,5-hexahydrotriazine or din itrosopentamethylenetetramine.

13. The active composition according to claim 5, wherein said compound contains at least one C—O fragment.

14. The active composition according to claim 4, wherein said further fuel contains a cyano compound.

15. The active composition according to claim 4, wherein said further fuel contains a paracyanogen.

16. The active composition according to claim 4, wherein said further fuel forms a mist by atomization during combustion of the active composition.

17. The active composition according to claim 16, wherein said further fuel is an ionic liquid.

18. The active composition according to claim 17, wherein said ionic liquid contains an imidazole, pyridine, diazine, a 1-butyl-3-methylimidazolium perchlorate (BMIM-ClO4) or other heterocyclic structure.

19. An active composition for a decoy radiating spectrally as the active composition burns up, including radiation emitted during combustion of the active composition in a wavelength range from 3.7 to 5.1 μm which is stronger by a factor of at least 15 than the radiation emitted during combustion of the active composition in the wavelength range from 1.9 to 2.3 μm, the active composition comprising:

a nitrate ester and a nitrosamine forming a fuel having carbon atoms and hydrogen atoms;

ammonium perchlorate as an oxidizer, an amount of said ammonium perchlorate being such that it is not sufficient for complete oxidation of said fuel; and the active composition containing either said nitrate ester being in a form of a polymeric solid, or a binder, not more than 5 of said carbon atoms in said fuel being joined to one another by direct bonding, and the active composition containing substantially no carbon source containing elemental carbon and apart from an optional catalyst, substantially no substances containing atoms other than carbon, hydrogen, nitrogen, oxygen, sulphur, chlorine and bromine.

20. The active composition according to claim 1, wherein said nitrate ester in the form of the polymeric solid is polyglycidlyl nitrate.

* * * * *